US007665575B2

(12) United States Patent
Tanaka et al.

(10) Patent No.: US 7,665,575 B2
(45) Date of Patent: Feb. 23, 2010

(54) SHOCK ABSORBING FABRIC STRUCTURES

(75) Inventors: Hajime Tanaka, Oxford, AL (US); Tim Russell, Anniston, AL (US)

(73) Assignee: YKK Corporation of America, Marietta, GA (US)

( * ) Notice: Subject to any disclaimer, the term of this patent is extended or adjusted under 35 U.S.C. 154(b) by 0 days.

(21) Appl. No.: 11/477,739

(22) Filed: Jun. 29, 2006

(65) Prior Publication Data

US 2006/0266581 A1 Nov. 30, 2006

Related U.S. Application Data

(62) Division of application No. 10/790,394, filed on Mar. 1, 2004, now abandoned.

(51) Int. Cl.
*A62B 35/00* (2006.01)

(52) U.S. Cl. ..... 182/3

(58) Field of Classification Search ..... 182/3–7, 182/18

See application file for complete search history.

(56) References Cited

U.S. PATENT DOCUMENTS

| | | | | |
|---|---|---|---|---|
| 3,444,957 | A | 5/1969 | Ervin, Jr. | |
| 3,550,956 | A | 12/1970 | Lowe | |
| 3,550,957 | A | 12/1970 | Radke et al. | |
| 3,804,698 | A | 4/1974 | Kinloch | |
| 3,861,744 | A | 1/1975 | Yamada et al. | |
| 3,872,895 | A * | 3/1975 | Takada | 139/383 R |
| 3,978,894 | A | 9/1976 | Boone | |
| 3,997,190 | A | 12/1976 | Seiffert et al. | |
| 4,004,616 | A | 1/1977 | Andronov et al. | |
| 4,138,157 | A | 2/1979 | Pickett et al. | |
| 4,209,044 | A * | 6/1980 | Taki | 139/411 |
| 4,253,544 | A | 3/1981 | Dalmaso | |
| 4,515,254 | A | 5/1985 | Markov et al. | |
| 4,538,702 | A | 9/1985 | Wolner | |
| 4,571,765 | A * | 2/1986 | Okada et al. | 8/149.3 |
| 4,604,315 | A * | 8/1986 | McCall et al. | 442/182 |

(Continued)

FOREIGN PATENT DOCUMENTS

| | | |
|---|---|---|
| EP | 0034458 | 8/1981 |

(Continued)

OTHER PUBLICATIONS

PCT/US2005/029140 International Search Report dated Jan. 13, 2006.

(Continued)

*Primary Examiner*—Alvin C Chin-Shue
(74) *Attorney, Agent, or Firm*—Kilpatrick Stockton LLP

(57) ABSTRACT

A shock absorbing fabric structure is a one-piece webbing. The shocking absorbing fabric structure has a sheath and an elongation member inside of the sheath. The sheath and the elongation member are secured together at spaced apart connection locations and the elongation member is generally not secured to the sheath between the connection locations. Heat treatment shrinks the length of the elongation member. The sheath does not substantially shrink from heat treatment relative to the elongation member and gathers together in an accordion-like arrangement. A tensile load applied to the fabric structure stretches the elongation member and unfolds the gathered sheath. The sheath supports the tensile load when completely unfolded while the elongation member absorbs energy as it stretches or elongates.

12 Claims, 2 Drawing Sheets

U.S. PATENT DOCUMENTS

| | | | | |
|---|---|---|---|---|
| 4,618,026 | A | 10/1986 | Olson | |
| 4,662,487 | A | 5/1987 | Koch | |
| 4,745,883 | A | 5/1988 | Baggetta | |
| 4,746,769 | A * | 5/1988 | Piper | 174/117 M |
| 4,853,175 | A * | 8/1989 | Book, Sr. | 376/216 |
| 4,853,275 | A | 8/1989 | Tracy et al. | |
| 4,897,902 | A * | 2/1990 | Kavesh et al. | 28/166 |
| 5,027,477 | A | 7/1991 | Seron | |
| 5,113,981 | A | 5/1992 | Lantz | |
| 5,143,187 | A | 9/1992 | McQuarrie et al. | |
| 5,174,410 | A | 12/1992 | Casebolt | |
| 5,202,177 | A | 4/1993 | Kamper | |
| 5,287,943 | A | 2/1994 | Bell | |
| 5,433,290 | A | 7/1995 | Ellis et al. | |
| 5,464,252 | A | 11/1995 | Kanazawa et al. | |
| 5,478,636 | A | 12/1995 | Koseki | |
| 5,529,343 | A | 6/1996 | Klink | |
| 5,564,476 | A * | 10/1996 | Golz | 139/388 |
| 5,598,900 | A | 2/1997 | O'Rourke | |
| 5,658,012 | A | 8/1997 | Villarreal et al. | |
| 5,799,760 | A | 9/1998 | Small | |
| 6,006,860 | A | 12/1999 | Bell | |
| 6,085,802 | A | 7/2000 | Silberberg | |
| 6,283,167 | B1 | 9/2001 | Chang et al. | |
| 6,299,040 | B1 | 10/2001 | Matias | |
| 6,347,466 | B1 * | 2/2002 | Lackner et al. | 38/102.4 |
| 6,390,234 | B1 | 5/2002 | Boyer | |
| 6,533,066 | B1 | 3/2003 | O'Dell | |
| 6,648,101 | B2 | 11/2003 | Kurtgis | |
| 6,739,427 | B2 | 5/2004 | Gayetty | |
| 6,776,317 | B1 | 8/2004 | Parker | |
| 2002/0180199 | A1 | 12/2002 | Schneider et al. | |
| 2003/0069557 | A1 * | 4/2003 | Driskell et al. | 604/385.3 |
| 2003/0173150 | A1 * | 9/2003 | Sharp | 182/3 |
| 2004/0173276 | A1 * | 9/2004 | Horikawa | 139/384 B |
| 2005/0056335 | A1 * | 3/2005 | Tielemans et al. | 139/383 A |
| 2005/0189169 | A1 | 9/2005 | Tanaka et al. | |
| 2007/0210639 | A1 | 9/2007 | Berger et al. | |
| 2008/0190691 | A1 | 8/2008 | Tanaka et al. | |
| 2009/0023352 | A1 | 1/2009 | Russell et al. | |
| 2009/0114307 | A1 | 5/2009 | Jennings et al. | |

FOREIGN PATENT DOCUMENTS

| | | | |
|---|---|---|---|
| EP | 0128662 | A2 | 12/1984 |
| EP | 0496028 | | 7/1992 |
| EP | 0665142 | B1 | 11/1996 |
| EP | 0851779 | B1 | 8/2000 |
| EP | 1069008 | | 1/2001 |
| EP | 0923403 | B1 | 4/2003 |
| JP | 05-084317 | | 4/1993 |
| JP | 05-141102 | | 6/1993 |
| JP | 06-081244 | | 3/1994 |
| JP | 07-246909 | | 9/1995 |
| JP | 08-182770 | | 7/1996 |
| WO | WO-93/12838 | | 7/1993 |
| WO | WO-97/10876 | | 3/1997 |
| WO | WO-98/41284 | | 9/1998 |
| WO | WO 01/26738 | A1 | 4/2001 |
| WO | WO-0126738 | | 4/2001 |
| WO | WO-2007011336 | | 1/2007 |
| WO | WO-2007/021278 | | 2/2007 |

OTHER PUBLICATIONS

PCT/US2009/033431 International Search Report and Written Opinion dated May 8, 2009.

PCT/US05/25043 International Search Report and Written Opinion mailed Nov. 1, 2005.

* cited by examiner

SHOCK ABSORBING FABRIC STRUCTURES

This application is a division of application Ser. No. 10/790,394 filed Mar. 1, 2004 now abandoned.

BACKGROUND OF THE INVENTION

The present invention generally pertains to lanyards and shock absorbing lanyards. More specifically, the present invention pertains to shock absorbing lanyards having a shock absorbing member and a load bearing web. The relative lengths of the shock absorbing member and the load bearing web are automatically adjusted. Also, the shock absorbing member and the load bearing web may be woven together. The present invention further pertains to methods of making shock absorbing lanyards. The present invention provides improved lanyards which can elongate, absorb energy and support a load.

People who are at elevated positions above a floor or other relatively lower surface can be at risk of falling and injury. For example, workers and other personnel who have occupations which require them to be at elevated positions, such as on scaffolding, can be at risk of falling and injury. Safety harnesses can be worn to stop a person's fall and prevent or reduce injury.

Safety harnesses typically have a harness portion worn by the user and a tether or lanyard extending from the harness portion. The lanyard connects the harness portion to a secure structure. If the person falls from the elevated position, the safety harness stops the person's fall when the lanyard is straightened. The person's fall is stopped rather abruptly and the person is subjected to the shock force of the abrupt stop.

Accordingly, needs exist to improve lanyards which reduce the shock experienced by the users of safety harnesses when a fall is stopped.

Lanyards which attempt to absorb the shock of a person's fall are known. However, needs exist for improved lanyards which reduce the shock of stopping a person's fall. Current lanyards have been made from two separate webbings assembled together. One webbing is a narrow, flat webbing woven of partially oriented yarn (POY webbing) and the other webbing is a relatively higher strength tubular-shaped webbing. After manufacture of the two webbings, the POY webbing is inserted into one end of the tubular-shaped webbing and pulled through the tubular-shaped webbing. A hook or other device inserted into the opposite end of the tubular-shaped webbing can be used to pull the POY webbing through the tubular-shaped webbing. The POY webbing is pulled through the tubular-shaped webbing so that the POY webbing extends inside of the tubular-shaped webbing from one end to the opposite end. The relative lengths of the POY webbing and the tubular-shaped webbing must be adjusted. While holding the POY webbing in place, one end of the tubular-shaped webbing is moved closer to the opposite end to place the tubular-shaped webbing in an accordion-like position over the POY webbing. The relative length adjustment of the webbings is performed manually and is a significant disadvantage of existing lanyards. After the manual adjustment of the relative webbing lengths, the POY webbing is essentially in a straight, linear orientation inside of the accordion-shaped orientation of the tubular-shaped webbing. The two webbings are then attached to each other by sewing at the ends. Any excess POY webbing extending out of the ends of the tubular-shaped webbing is cut off and discarded.

Those existing lanyards exhibit disadvantages and can be improved. For example, the lanyards are made from two separate webbings which must be assembled together. Manufacture of the lanyards requires costly and tedious assembly processes, such as inserting the POY webbing through the tubular-shaped webbing. Also, after the insertion process, an additional process is required to place the tubular-shaped webbing in the accordion position while maintaining the POY webbing in a straight position, i.e., adjust the relative webbing lengths. Furthermore, a manual process is used to adjust the relative webbing lengths. Then, another process must attached the two separate webbings together while maintaining the POY webbing in the straight position and the tubular-shaped webbing in the accordion-shaped position. The relative lengths of the POY webbing and the tubular-shaped webbing is critical for proper functioning of the lanyard. The manufacturing process is complicated by proper control and manual setting of the critical relative lengths of the two webbings.

Existing lanyards which purport to reduce shock can be found in U.S. Pat. Nos. 5,113,981; 6,085,802; 6,390,234; and 6,533,066 and WIPO Publication No. WO/01/026738.

For the reasons mentioned above and for other reasons, lanyards and shock absorbing lanyards can be improved. For example, one improvement would be to provide a shock absorbing lanyard which has a shock absorbing member and a load bearing web in which the relative lengths of the webs are automatically adjusted. Furthermore, methods of making lanyards can also be improved. One improved method of making a lanyard, for example, would be to adjust the relative lengths of a shock absorbing member and a load bearing web by shrinking the length of the shock absorbing member.

SUMMARY OF THE INVENTION

New lanyards are provided by the present invention. The present invention particularly provides new shock absorbing lanyards. The present invention also provides new methods of making lanyards. One shock absorbing lanyard is a woven one-piece webbing and has a woven tubular-shaped high strength outer sheath and a high elongation member (for example, POY yarns) woven inside of the outer sheath. The outer sheath and the high elongation member are secured together at spaced apart connection locations and the high elongation member is generally not secured to the outer sheath between the connection locations. Heat treatment shrinks the length of the high elongation member. The outer sheath does not substantially shrink from the heat treatment relative to the high elongation member, and gathers together in an accordion-like arrangement. A tensile load applied to the lanyard stretches the high elongation member and unfolds the gathered high strength outer sheath. The high strength outer sheath supports the tensile load when completely unfolded while the high elongation member absorbs energy as it stretches. The new lanyards can be used to stop a person's fall and reduce a shock force felt by the user when the fall is stopped.

One lanyard according to the present invention has a load-supporting outer sheath, and heat shrunken elongation member extending along an inside of the outer sheath. First and second spaced apart connection locations are provided in which the elongation member is secured to the load-supporting outer sheath. The elongation member has an un-stretched, heat shrunken length between the first and second connection locations substantially shorter than a length of the outer load-supporting sheath between the first and second connection locations.

The lanyard may also have a binder yarn that secures the elongation member to the load-supporting outer sheath.

The elongation member may be made from elongation yarns (such as POY yarns) and can be secured to the woven outer sheath by the elongation yarns and yarns of the outer sheath being interlaced together. A binder yarn may be interlaced with the elongation yarns and the yarns of the outer sheath.

Stitching may be used to secure the elongation member to the outer sheath.

At least one of the elongation member and the load-supporting outer sheath maybe selected from the group consisting of woven materials, braided materials, knitted materials, non-woven materials, and combinations thereof.

The lanyard may have a portion which has the elongation member extending from inside of the outer sheath to an exterior surface of the outer sheath.

Another lanyard according to the present invention has a tubular-shaped webbing, and heat-shrunk elongation yarns inside of the tubular-shaped webbing. The lanyard also has first and second spaced apart binder portions in which the heat-shrunk elongation yarns are secured to the tubular-shaped webbing. An expansion portion is provided between the first and second binder portions in which the heat-shrunken elongation yarns are extensible relative to the tubular-shaped webbing and the tubular-shaped webbing is in a gathered position.

The lanyard may also have a binder yarn, wherein the heat-shrunken elongation yarns are secured to the tubular-shaped webbing by the binder yarn.

The heat-shrunk elongation yarns may be secured to the tubular-shaped webbing by the heat-shrunk elongation yarns and yarns of the tubular-shaped webbing being interlaced together. Also, the lanyard may have a binder yarn interlaced with the heat-shrunk elongation yarns and the yarns of the tubular-shaped webbing.

The heat-shrunk elongation yarns may be secured to the tubular-shaped webbing by stitching.

At least one of the heat-shrunk elongation yarns and the tubular-shaped webbing is selected from the group consisting of woven materials, braided materials, knitted materials, non-woven materials, and combinations thereof.

The lanyard may have another binder portion in which the heat-shrunk elongation yarns are secured to the tubular-shaped webbing with a different structure than the first and second binder portions.

The lanyard may also have a hardware attachment portion having the heat-shrunk elongation yarns extending from inside of the tubular-shaped webbing to an outside of the tubular-shaped webbing.

One method of making a lanyard according to the present invention includes forming an outer sheath and elongation yarns within the outer sheath; securing the elongation yarns to the outer sheath at connection locations; and reducing a length of the elongation yarns between a pair of the connection locations.

The reducing step of the lanyard making method may include heat treating at least the elongation yarns.

The securing step of the lanyard making method may include interweaving a binder yarn with the elongation yarns and yarns of the outer sheath.

In the method of making a lanyard, the securing step may include interweaving the elongation yarns and yarns of the outer sheath. The securing step may further include interweaving a binder yarn with the elongation yarns and the yarns of the outer sheath.

The securing step of the method may include sewing the elongation yarns and the yarns of the outer sheath together.

In the method of making a lanyard, the reducing step may not substantially reduce a length of the outer sheath between the pair of connection locations.

One advantage of the present invention is to provide improved lanyards, such as improved shock absorbing lanyards.

An advantage of the present invention is to automatically adjust the relative lengths of a high elongation member and a load bearing member of a shock absorbing lanyard.

Another advantage of the present invention is to form a shock absorbing lanyard by shrinking the length of a shock absorbing member relative to a load bearing web.

Another advantage of the present invention is to provide improved shock absorbing lanyards which have a shock absorbing member and a load bearing web woven together.

Yet another advantage of the present invention is to provide lanyards which can stop a person's fall while reducing the shock force to the person.

Further advantages of the present invention are to improve manufacturing of lanyards and reduce costs of lanyards.

An even further advantage of the present invention is to control the relative lengths of a shock absorbing member and a load bearing web during manufacture of shock absorbing lanyards.

Additional features and advantages of the present invention are described in, and will be apparent from, the following Detailed Description of the Invention and the figures. The features and advantages may be desired, but, are not necessarily required to practice the present invention.

DETAILED DESCRIPTION OF THE INVENTION

The present invention provides new lanyards. The present invention particularly provides new shock absorbing lanyards which can stop a person or object from falling and reduce shock to the person or object. One new shock absorbing lanyard according to the present invention has a shock absorbing member or web woven with a load bearing web. The present invention, however, can be practiced in many different embodiments.

Figure 1:
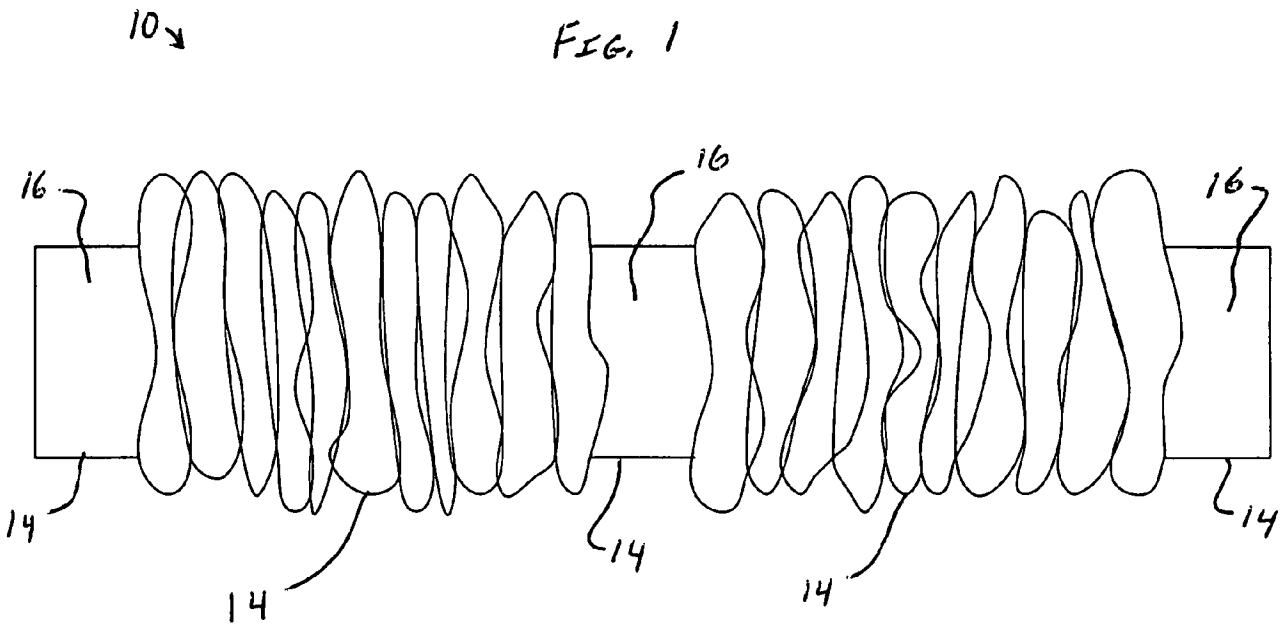
FIG. 1 is a schematic view of a shock absorbing lanyard according to the principles of the present invention.

An example of the present invention is shown in FIG. 1 which shows a shock absorbing lanyard 10. The shock absorbing lanyard 10 is a woven webbing having high elongation yarns 12 (see FIG. 2) inside of a woven outer sheath or shell 14 of high strength yarn. The high elongation yarns 12 are highly extensible and significantly stretch when placed under a suitable tensile load. The high elongation yarns 12 can have any desired configuration, such as woven together or non-woven, for example. The high elongation yarns 12 are one example of shock absorbing members of the lanyard 10. The high strength outer sheath 14 is woven in a tubular shape with the high elongation yarns 12 extending through the inside of the outer sheath 14. The high strength outer sheath 14 supports a load applied to the lanyard 10 after the high elongation yarns 12 elongate and under the load. The shock absorbing lanyard 10 is formed with the simultaneous weaving of the high elongation yarns 12 with the high strength yarns of the outer sheath 14. Thus, the shock absorbing lanyard 10 is woven as a one-piece webbing. The high elongation yarns 12 and the high strength outer sheath 14 can each be made from materials having any desired structure, for example, woven materials, braided materials, knitted materials, non-woven materials, and combinations thereof.

The high elongation yarns 12 can be loose inside of the outer sheath 14 except for connection locations 16. The high elongation yarns 12 and the yarns of the outer sheath 14 are connected and secured together at the connection locations 16. For example, the high elongation yarns 12 and the yarns of the outer sheath 14 can be integrally woven or interlaced together. The interlaced weaving of the high elongation yarns 12 and the yarns of the outer sheath 14 secures the two types of yarns together during weaving of the shock absorbing lanyard 10. Preferably, the high elongation yarns 12 are secured to the outer sheath 14 such that the high elongation yarns 12 and the outer sheath 14 cannot be separated at the connection locations 16 during normal use. Another example of the structure of the connection locations 16 is to secure the high elongation yarns 12 to the outer sheath 14 by stitching the yarns 12 and the outer sheath 14 together.

FIG. 1 shows the shock absorbing lanyard 10 in a finished form in which the outer sheath 14 is in an accordion-like configuration. The high elongation yarns 12 inside of the outer sheath 14 are substantially loose, except for the connection locations 16, and have a generally linear configuration rather than the accordion-like configuration of the outer sheath 14. The accordion-like configuration of the outer sheath 14 is automatically formed by a heat treating process after the woven lanyard webbing comes off of the loom.

Figure 2:
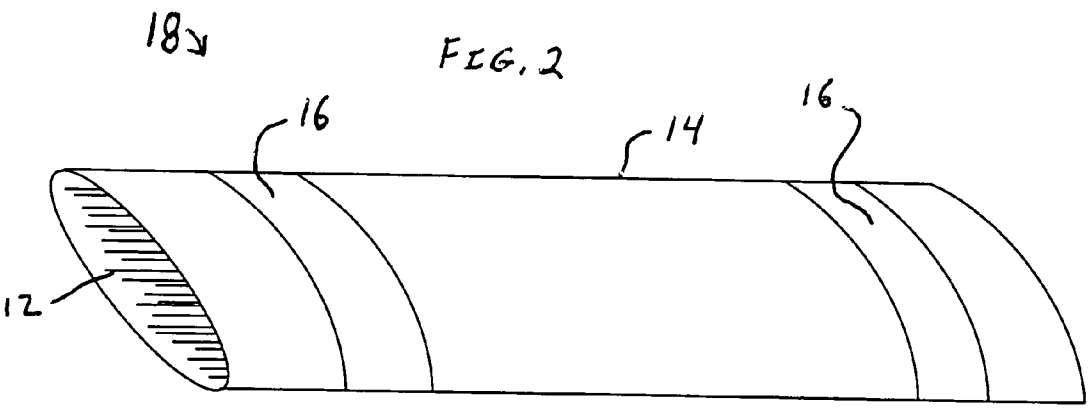
FIG. 2 shows the shock absorbing lanyard of FIG. 1 during manufacture.

FIG. 2 shows the shock absorbing lanyard 10 during manufacture as a woven webbing 18 prior to heat treatment. The woven webbing 18 from the loom has the high elongation yarns 12 inside of the outer sheath 14. The high elongation yarns 12 are interlaced with the yarns of the outer sheath 14 at connection locations 16. The woven webbing 18 is subjected to a heat treatment process to form the shock absorbing lanyard 10. The high elongation yarns 12 are made of one or more materials that shrink in length during heat treatment. The yarns of the outer sheath 14 are made of one or more materials which do not shrink in length or shrink substantially less than the high elongation yarns 12. Because the high elongation yarns 12 and the outer sheath 14 are connected together at the connection locations 16 and the length of the high elongation yarns 12 reduces significantly relative to the length of the yarns of the outer sheath 14, the shrinking high elongation yarns 12 draws the connection locations 16 closer together. The length of the yarns of the outer sheath 14 are not significantly reduced relative to the length of the high elongation yarns 12. The length of the outer sheath 14 is forced to occupy a shorter distance due to the reduced-length high elongation yarns 12 and thus, the outer sheath 14 gathers together or bunches up. In this manner, the outer sheath 14 automatically forms an accordion-like configuration after heat treatment of the woven webbing 18.

Important properties of the shock absorbing member (e.g., the high elongation yarns 12) include high elongation, high shrinkage, and high shrink-force (the force produced during the shrinkage) to "accordion" the outer sheath. The shock absorbing member 12 should have sufficient high elongation under load to absorb the load energy. The shrink-force should be sufficiently strong to make the outer sheath gather up. The shrinkage should be sufficiently high to achieve the correct relative lengths between the shock absorbing member 12 and the outer sheath 14.

The relative lengths of the high elongation yarns 12 and the outer sheath 14 in the finished lanyard 10 are important. During use of the shock absorbing lanyard 10, the finished relative lengths provide for proper elongation of the lanyard 10 (stretching of the high elongation yarns 12 and unfolding of the outer sheath 14) to stop a person's fall and reduce the shock force otherwise felt by the person. The relative lengths of the high elongation yarns 12 and the outer sheath 14 are easily, conveniently and accurately controlled because the high elongation yarns 12 and the outer sheath are woven together, i.e., as a one-piece woven webbing. Also, the heat treating process of the present invention provides easy, convenient and accurate control of the relative lengths by shrinking the high elongation yarns 12 relative to the outer sheath 14, preferably after the high elongation yarns 12 and the outer sheath are secured together. In this manner, the relative lengths of the high elongation yarns 12 and the outer sheath 14 are automatically adjusted. The relative lengths do not have to be adjusted prior to assembly of the high elongation yarns to the outer sheath. Prior lanyards had the relative lengths adjusted or set prior to assembly of the POY yarns to the outer tubular-shaped webbing.

Various heat treating processes can be used for the present invention. For example, a continuous oven can be used in an in-line, continuous heating process. The lanyard webbing can be continuously woven and fed into the continuous oven for heat treatment. After exiting the continuous oven, the continuous lanyard webbing can be cut to a desired length to provide an individual lanyard. Another example of heat treatment is a batch process in which individual lanyards are heat treated.

The high elongation yarns 12 have an elongation property which allows the yarns 12 to be significantly stretched under tension. The high elongation yarns 12 have the elongation property even after the heat treatment process. When the shock absorbing lanyard 12 is placed under tensile load, the high elongation yarns 12 stretch under tension and absorb the force or energy applied to the lanyard 10. Accordingly, the high elongation yarns 12 are a shock absorbing member that provides the shock absorbing feature of the present invention. Partially oriented yarns (POY yarns) made of polymer materials is an example of suitable yarns for the high elongation yarns 12 of the present invention. Other suitable materials can be used for the high elongation yarns 12 in which the materials have high elongation properties and can shrink in length, such as during heat treatment. Also, other high elongation members can be used as the shock absorbing member.

The outer sheath 14 can be woven as a flattened, tubular-shaped webbing. The flattened, tubular-shape of the outer sheath 14 provides top and bottom outer sheath layers with the high elongation yarns 12 between the top and bottom outer sheath layers, i.e. the high elongation yarns 12 are inside of the outer sheath. The outer sheath 14 can, of course, have other configurations. The outer sheath 14 is made from relatively higher strength yarns. For example, high strength yarns which form an outer sheath 14 having at least 5,000 lbs tensile strength can be used for the outer sheath 14. Other suitable materials can be used for the yarns of the outer sheath 14 to provide a desired load strength to the lanyard 10.

Figure 3:
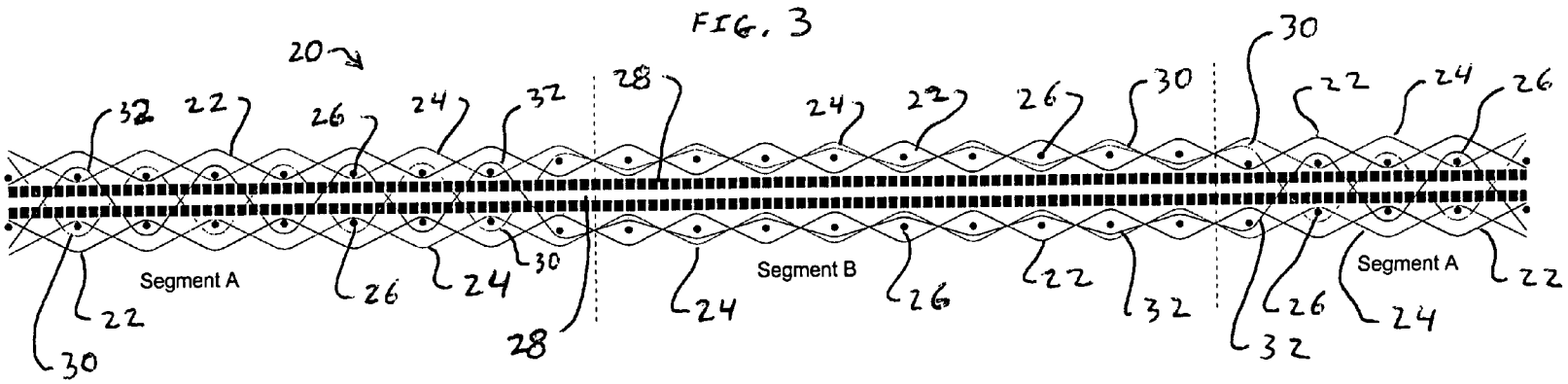
FIG. 3 shows a weaving pattern of the shock absorbing lanyard of FIG. 1.

FIG. 3 shows one weaving pattern 20 of the shock absorbing lanyard 10. The weaving pattern 20 of the shock absorbing lanyard 10 has ground yarns 22, 24, 26 which form the outer sheath 14. A high elongation member 28, such as POY yarns, extends along the inside of the outer sheath between the upper ground yarns 22, 24, 26 and the lower ground yarns 22, 24, 26. The weaving pattern 20 also has binder yarns 30, 32. Other yarns or components could be included in a lanyard having the weaving pattern 20.

As shown in FIG. 3, the shock absorbing lanyard 10 has two main types of segments, segments A and B. Segment B forms an expansion portion of the shock absorbing lanyard 10 which expands during use of the lanyard 10. Segment B has a tubular weave outer sheath. The high elongation member 28 (which can be POY material) is inside of the tubular outer sheath and is allowed to shrink freely during heat treatment. The outer sheath or tubular weave may be woven in any manor that results in a tubular woven web having the high elongation member 28 positioned between the upper and lower outer sheath webbing portions. The weave type, warp density, warp material size and type, weft density, weft material size and type, and the high elongation member material size and type can be selected or varied as desired. The example of FIG. 3 shows segment B of the shock absorbing lanyard 10 having the binder yarn 30 woven or interlaced with the upper ground yarns 22, 24, 26 and the binder yarn 32 woven or interlaced with the lower ground yarns 22, 24, 26. In segment B of the shock absorbing lanyard 10, the high elongation member 28 is generally loose within the outer sheath and not attached to the yarns 22, 24, 26 of the outer sheath. The high elongation member 28 is woven as stuffer or core material within the tubular weaving of the ground yarns 22, 24, 26. The binder yarns 30, 32 may also be woven as stuffer or core material inside of the tubular woven web with the high elongation member 28.

Segment A forms a binding portion of the shock absorbing lanyard 10. Segment A of the shock absorbing lanyard 10 is the portion of the lanyard in which the high elongation member 28 is connected and secured to the outer sheath. The example of FIG. 3 shows binder yarns 30, 32 integrally woven with the upper and lower ground yarns 22, 24, 26 and the high elongation member 28. Accordingly, the binder yarns 30, 32 secure the high elongation member 28 to the outer sheath. Other examples of weaving suitable for segment A provides the upper ground yarns interlacing with the lower ground yarns with or without the binder yarns. The segments A, A of FIG. 3 are the connection locations 16 of FIGS. 1 and 2.

When a shock absorbing lanyard 10 having the weaving pattern 20 is subjected to heat treatment, the high elongation member 28 shrinks in length and the opposite segments A, A move closer together because the high elongation member 28 is secured to the outer sheath. The segment B reduces in length between the opposite segments A, A. The ground yarns 22, 24, 26 of the outer sheath do not shrink, and in segment B the outer sheath gathers together to form the accordion-like configuration. Materials for the outer sheath yarns 22, 24, 26 could be used which shrink during heat treatment. However, the outer sheath should shrink substantially less than the high elongation member 28 to maintain a desired length differential between the high elongation member 28 and the outer sheath.

Figure 4:
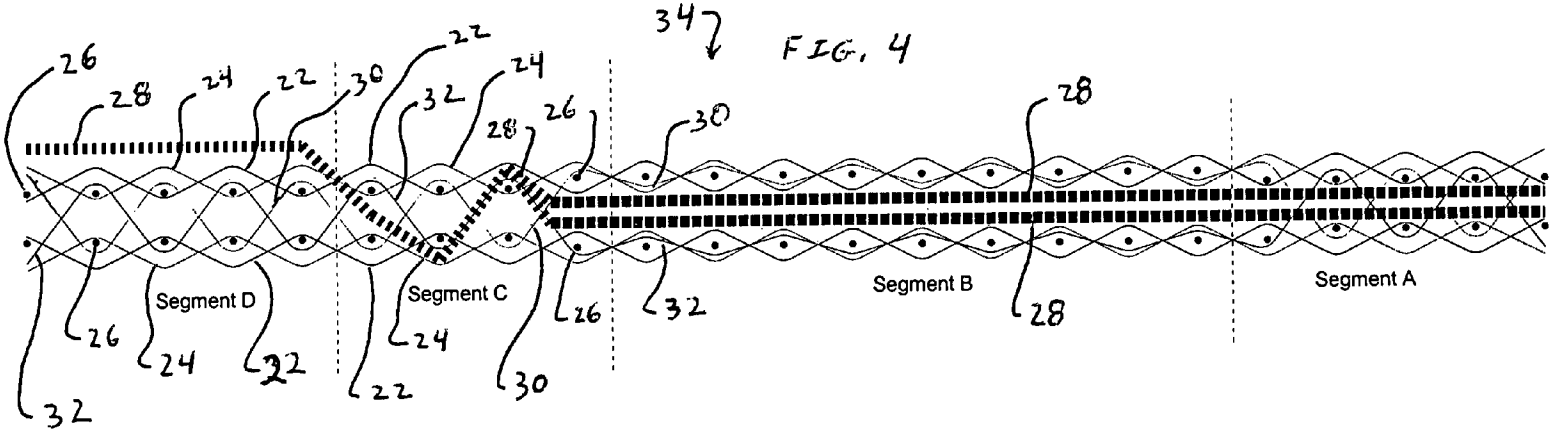
FIG. 4 shows another weaving pattern of the shock absorbing lanyard.

FIG. 4 shows another weaving pattern 34 of the shock absorbing lanyard 10. FIG. 4 shows one configuration in which the ground yarns 22, 24, 26 are woven as a tubular webbing, the binder yarn 30 is woven as a binder, and the high elongation member 28 is woven from the upper ground yarns 22, 24, 26 to the lower ground yarns 22, 24, 26. The segments A and B of FIG. 4 are the same as segments A and B, respectively, of FIG. 3. Segment C anchors and secures the high elongation member 28 to the outer sheath and is another example of a binder portion and connection location 16. Segment C provides the high elongation member 28, such as POY yarns, to be integrally woven or interlaced with the outer sheath ground yarns 22, 24, 26. Other weaving patterns can be used for segment C such that the materials, particularly the weft and warp yarns, are interlaced with each other in a structure that secures the high elongation member 28 to the outer sheath webbing and may not be pulled out of the outer sheath webbing under a load of the size intended for use of the lanyard.

Segment D of FIG. 4 forms a hardware attachment portion of the lanyard 10. The lanyard 10 should be flat at segment D and suitable for attachment to the hardware, such as a metal clasp. Segment D may have any weave configuration that results in flat webbing suitable for hardware attachment or attachment to another webbing. One example of weaving suitable for segment D is shown in FIG. 4 as a closed tubular webbing of the yarns 22, 24, 26, 30, 32 with the high elongation material 28 woven outside the webbing. The high elongation material 28 may be trimmed from the webbing in segment D. After heat treatment little shrinkage will occur in segment D while not affecting any shrinkage in the other segments. Additional examples of weaving patterns suitable for hardware attachment portion segment D are the weaving patterns of segment A and segment C.

Figure 5:
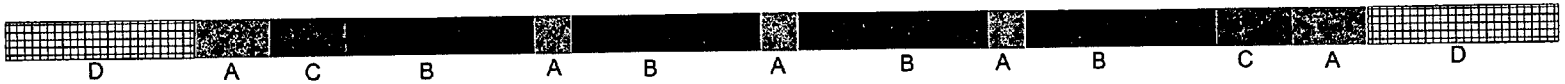
FIG. 5 schematically shows another shock absorbing lanyard according to the present invention.

FIG. 5 shows a schematic illustration of a shock absorbing lanyard 36 having segments A, B, C, D shown in the weaving patterns 20, 34 of FIGS. 3 and 4. Segment D is a hardware attachment portion, segment A is binder portion, segment C is a securing portion, and segment B is a tubular portion. One end of the lanyard 36 at one hardware attachment portion segment D can be attached to a harness worn by a user and the opposite end at the opposite hardware attachment portion segment D can be attached to a load-supporting structure. The number, arrangement and size of the segments A, B, C, D shown in FIG. 5 can changed as desired to provide a particular lanyard. All segments A, B, C, D are not necessarily required.

The shock absorbing lanyard 10 can be used as a fall protection device. One end of the shock absorbing lanyard 10 is securely attached to a safety harness worn by a user. The opposite end of the shock absorbing lanyard 10 is securely attached to a fixed structure. If the user falls, the shock absorbing lanyard 10 stops the person's fall and reduces the shock felt by the person as the user is quickly brought to a stop. As the person falls, the shock absorbing lanyard 10 straightens and the load of the user begins to be applied to the lanyard 10. The high elongation yarns 12 stretch and absorb the force of the load applied to the lanyard 10. As the high elongation yarns 12 stretch, the outer sheath 14 elongates as the accordion shape unfolds. When the outer sheath 14 reaches its maximum length, i.e. the accordion shape is completely unfolded, the lanyard 10 stops the person from falling any farther. The high strength outer sheath 14 carries the load applied to the expanded lanyard 10. The shock of stopping the fall that would otherwise be felt by the falling person is reduced or cushioned by the energy-absorbing high elongation yarns 12.

In one embodiment of the present invention, a shock absorbing lanyard 10 is designed to stop a falling person within 9½ feet. The shock absorbing lanyard 10 has POY yarns for the high elongation yarns 12 and yarns for the outer sheath 14 which provide a minimum of 5,000 lbs tensile strength. The lanyard 10 has a finished, ready-for-use length of about 6'. The lanyard 10 is formed from a woven webbing 18 having a length of about 9½'. After heat treatment, the high elongation yarns 12 have a reduced length of about 6' and the outer sheath 14 retains its 9½' length. However, the outer sheath 14 is longitudinally gathered together to form the accordion-like shape over the 6' finished length. During use of the shock absorbing lanyard 10, the high elongation yarns 12 will stretch from about 6' to about 9½', unfolding the accordion-shaped outer sheath 14 to the maximum length of about 9½'. Of course, when the shock absorbing lanyard 10 reaches the maximum 9½' length, the lanyard 10 stops the person's fall. The high elongation yarns 12 absorb the energy of the fall and reduce the abrupt shock to the person when the lanyard 10 stops the fall.

In another embodiment of the present invention, a shock absorbing lanyard has lengths of the high elongation yarns and the outer sheath to stop a falling person within about 3½'. Of course, lanyards can be made in any desired length according to the present invention.

The lanyards of the present invention can be made of any materials suitable for lanyards. For example, the lanyards can be made of synthetic materials, such as synthetic material yarns woven to form the lanyard.

The lanyards of the present invention can be used in a wide variety of applications. For example, the lanyards can be used as shock absorbing lanyards for safety harnesses. Shock absorbing lanyards according to the present invention can stop a person's fall while absorbing at least some of the shock force due to the stop of the fall that would otherwise be felt by the person.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A method of making a fabric structure comprising:

(1) weaving a webbing comprising: a plurality of ground yarns that form a sheath, a plurality of elongation yarns surrounded by the sheath, wherein the elongation yarns are partially oriented yarns, and a plurality of binder yarns, the weaving step further comprising:

(a) weaving a first connection segment, including interweaving the binder yarns with the ground yarns and the elongation yarns;

(b) weaving an expansion segment having first and second ends wherein the first end of the expansion segment is adjacent to the first connection segment, including weaving the binder yarns with the plurality of ground yarns of the sheath without weaving the binder yarns with the elongation yarns;

(c) weaving a second connection segment adjacent to the second end of the expansion segment, including interweaving the binder yarns with the ground yarns and the elongation yarns; and (2) applying heat to the expansion segment, whereby in the expansion segment the length of the elongation yarns is reduced to be shorter than the length of the ground yarns.

2. The method of claim 1, wherein weaving the first connection segment comprises interweaving the elongation yarns and the ground yarns.

3. The method of claim 1, wherein weaving the second connection segment comprises interweaving the elongation yarns and the ground yarns.

4. The method of claim 1, wherein weaving the expansion segment comprises leaving the elongation yarns substantially loose and in a generally linear configuration within the sheath.

5. The method of claim 1, wherein weaving the expansion segment comprises weaving the elongation yarns within the sheath.

6. The method of claim 1, wherein applying heat comprises applying sufficient heat to automatically adjust the length of the elongation yarns so that the difference in length between the elongation yarns and the sheath is sufficient to allow the elongation yarns to stretch under application of a predetermined load that is less than a breaking strength of the sheath.

7. The method of claim 1, wherein applying heat comprises an in-line continuous heating process.

8. The method of claim 1, wherein applying heat comprises heat treating at least one fabric structure in a batch process.

9. The method of claim 1, wherein weaving the sheath comprises weaving a webbing comprising a top sheath layer and a bottom sheath layer, wherein the elongation members are positioned between the top sheath layer and the bottom sheath layer.

10. The method of claim 9, wherein the top sheath layer comprises upper ground yarns and the bottom sheath layer comprises lower ground yarns and wherein weaving the first connection segment comprises interlacing the upper ground yarns and the lower ground yarns.

11. The method of claim 10, wherein weaving the second connection segment comprises interlacing the upper ground yarns and the lower ground yarns.

12. The method of claim 1, wherein the ground yarns of the sheath collectively have a tensile strength of at least 5,000 lbs.

* * * * *